US007557590B2

(12) United States Patent
Yakabe

(10) Patent No.: US 7,557,590 B2
(45) Date of Patent: Jul. 7, 2009

(54) CAPACITANCE DETECTION CIRCUIT AND CAPACITANCE DETECTION METHOD

(75) Inventor: Masami Yakabe, Tokyo (JP)

(73) Assignee: Tokyo Electron Limited, Tokyo (JP)

( * ) Notice: Subject to any disclaimer, the term of this patent is extended or adjusted under 35 U.S.C. 154(b) by 533 days.

(21) Appl. No.: 10/567,092

(22) PCT Filed: Aug. 5, 2004

(86) PCT No.: PCT/JP2004/011577

§ 371 (c)(1),
(2), (4) Date: Feb. 3, 2006

(87) PCT Pub. No.: WO2005/015246

PCT Pub. Date: Feb. 17, 2005

(65) Prior Publication Data

US 2008/0150553 A1 Jun. 26, 2008

(30) Foreign Application Priority Data

Aug. 6, 2003 (JP) ..... 2003-287991

(51) Int. Cl.
*G01R 27/26* (2006.01)

(52) U.S. Cl. ..... 324/686; 340/545.4; 324/664; 324/683; 702/52; 341/33; 345/174

(58) Field of Classification Search ..... 324/686
See application file for complete search history.

(56) References Cited

U.S. PATENT DOCUMENTS 3,646,538 A 2/1972 Frick
5,285,120 A * 2/1994 Landt ..... 327/255
6,005,439 A * 12/1999 Fong ..... 330/253
6,441,475 B2 * 8/2002 Zandman et al. ..... 257/685
6,456,477 B1 * 9/2002 McIntosh et al. ..... 361/115
6,724,324 B1 * 4/2004 Lambert ..... 341/33
6,950,514 B2 * 9/2005 Enriquez et al. ..... 379/413
7,250,773 B2 * 7/2007 Takekawa et al. ..... 324/662
2002/0033504 A1 3/2002 Ohnakado (Continued)

FOREIGN PATENT DOCUMENTS

EP 0 723 166 A1 7/1996

(Continued)

OTHER PUBLICATIONS

European Search Report. Aug. 28, 2007, PCT/JP2004011577.

(Continued)

*Primary Examiner*—Diego Gutierrez
*Assistant Examiner*—Benjamin M Baldridge
(74) *Attorney, Agent, or Firm*—Finnegan, Henderson, Farabow, Garrett & Dunner, L.L.P.

(57) ABSTRACT

A capacitance detection circuit containing an input protection circuit and having high sensitivity is provided. A capacitance detection circuit for detecting the capacitance of a capacitive sensor, comprising a buffer amplifier connected to the capacitive sensor via a signal wire and having a voltage gain of 1; diodes connected in series between the signal wire and a positive power supply; diodes connected in series between the signal wire and a negative power supply, wherein an output terminal of the buffer amplifier is connected to a junction point of the diodes and to a junction point of the diodes.

14 Claims, 7 Drawing Sheets

(+Vdd≧Vp≧Vh≧Vm≧-Vdd)

U.S. PATENT DOCUMENTS

| | | | | |
|---|---|---|---|---|
| 2002/0074988 | A1* | 6/2002 | Taylor | 324/76.52 |
| 2002/0109153 | A1* | 8/2002 | Ker et al. | 257/199 |
| 2002/0130390 | A1 | 9/2002 | Ker et al. | |
| 2002/0154039 | A1* | 10/2002 | Lambert et al. | 341/33 |
| 2003/0067451 | A1* | 4/2003 | Tagg et al. | 345/174 |
| 2004/0160234 | A1* | 8/2004 | Denen et al. | 324/679 |
| 2004/0252426 | A1 | 12/2004 | Hargrove et al. | |
| 2005/0077909 | A1* | 4/2005 | Lalla | 324/658 |
| 2006/0017449 | A1* | 1/2006 | Takekawa et al. | 324/683 |

FOREIGN PATENT DOCUMENTS

| | | |
|---|---|---|
| JP | 05-335493 | 12/1993 |
| JP | 2003-75486 | 3/2003 |

OTHER PUBLICATIONS

Form PCT/IB/338 and English language translation of the International Preliminary Report on Patentability in connection with PCT/JP2004/011577. May 18, 2006.

* cited by examiner (+Vdd≧Vp≧Vh≧Vm≧-Vdd)

CAPACITANCE DETECTION CIRCUIT AND CAPACITANCE DETECTION METHOD

TECHNICAL FIELD

The present invention relates to a circuit that detects electrostatic capacitance and particularly to a circuit that outputs a signal corresponding to variant component of very small electrostatic capacitance.

BACKGROUND ART

A capacitance detection circuit 10 shown in FIG. 1 conventionally exists as a detection circuit of a capacitive sensor of which electrostatic capacitance (hereinafter, referred to simply as "capacitance") changes corresponding to a variance in physical quantity.

This capacitance detection circuit 10 is a circuit that outputs a voltage signal corresponding to capacitance of a capacitive sensor Cs and is constructed of: the capacitive sensor Cs; an input protection circuit 11; a resistor Rh; a buffer amplifier 12; a signal wire 13 that connects the capacitive sensor Cs and the buffer amplifier 12; and the like. (Refer to, for example, Laid-open Japanese patent application No. 5-335493 as an input protection circuit.)

Voltage Vb is applied to an electrode of the capacitive sensor Cs and other electrode is connected to an input terminal of the buffer amplifier 12 via the signal wire 13. The input protection circuit 11 is a circuit that clamps high voltage, such as the voltage caused by static electricity accumulated in the signal wire 13, and is composed of diodes Dp and Dm connected between the signal wire 13 and positive power supply (+Vdd) and negative power supply (−Vdd).

The conventional capacitance detection circuit 10 operates as follows.

Now, suppose that parasitic capacitance (stray capacitance) of the signal wire 13 is Ci, and input voltage Vin of the buffer amplifier 12 is divided voltage of voltage Vb applied to the capacitive sensor Cs and determined by the capacitive sensor Cs and the parasitic capacitance Ci.

$$Vin=Vb\cdot(1/j\omega Ci)/(1/j\omega Cs+1/j\omega Ci)$$

By the way, the voltage gain of the buffer amplifier 12 being 1,

Vout=Vin holds.

Therefore, when Vin is deleted in the above two equations, output voltage Vout is:

$$Vout=Vb\cdot Cs/(Cs+Ci)$$

Here, suppose that capacitance of the capacitive sensor Cs is represented by adding a capacitance component that depends on a variance in physical quantity (variant capacitance ΔC) and a capacitance component that does not depend on a variance in physical quantity (reference capacitance Cd), in other words, suppose that it is represented by $$Cs=Cd+\Delta C$$

The above-mentioned output voltage Vout is:

$$Vout=Vb\cdot(Cd+\Delta C)/(Cd+\Delta C+Ci)$$

Here, when Vb is DC voltage, only AC component Vo of the output voltage Vout corresponding to a variance in physical quantity is a final signal. Therefore, the AC component Vo is:

$$Vo=Vb\cdot\Delta C/(Cd+\Delta C+Ci) \quad \text{(Equation 1)}$$

(Here, it is possible to state that Vo is component that depends on a temporal variance in physical quantity, "for example, ΔC".)

As is apparent from the above Equation 1, to improve sensitivity of the capacitance detection circuit like this, it is preferable to diminish or null the parasitic capacitance Ci because ΔC, Cd and Vb are constant.

It is not easy, however, to diminish the parasitic capacitance Ci.

FIG. 2 is an equivalent circuit diagram when the capacitance detection circuit 10 shown in FIG. 1 operates normally (when diodes Dp and Dm are reversely biased.) Here, capacitance of diode Dp and capacitance of diode Dm (depletion layer capacitance when being reversely biased) are illustrated as capacitors Cdp and Cdm, respectively and input capacitance of the buffer amplifier 12 is illustrated as a capacitor Cg. The parasitic capacitance Ci is a total value of capacitance of these capacitors, Cdp, Cdm and Cg:

$$Ci=Cdp+Cdm+Cg$$

All of them, however, are parasitic capacitance produced by an essential circuit including the diode Dp, the diode Din, and the buffer amplifier 12.

Here, if it is possible to form the whole capacitance detection circuit 10 with a one-chip IC, it is possible to reduce the parasitic capacitance Ci substantially without providing the input protection circuit 11. However, when it is necessary to produce a product by assembling two or more kinds of parts or to implement a capacitive sensor Cs and a detection circuit at positions far apart or the like, it is inevitable to implement a capacitance detection circuit with a structure in which the capacitive sensor Cs and the detection circuit are separated. It is, therefore, unavoidable to provide the input protection circuit 11 in the input stage of the buffer amplifier 12. Consequently, parasitic capacitance caused by the input protection circuit 11 is added and there is a problem that the sensitivity of the capacitance detection circuit deteriorates.

DISCLOSURE OF INVENTION

Thus, the present invention is made considering the problem like this and aims to provide a capacitance detection circuit that contains an input protection circuit and has high sensitivity.

To achieve the above-mentioned object, the capacitance detection circuit according to the present invention is skillfully designed to cancel capacitance of the diodes that form the input protection circuit.

In other words, the capacitance detection circuit according to the present invention is a capacitance detection circuit comprising: a first buffer amplifier unit connected to a capacitor to be detected via a signal wire; a first diode and a second diode connected in series between the signal wire and a first power supply; and a third diode and a fourth diode connected in series between the signal wire and a second power supply, wherein an output terminal of the first buffer amplifier unit is connected to a first junction point of the first diode and the second diode and to a second junction point of the third diode and the fourth diode. Hereby, since the both ends of the first and the third diodes connected to the signal wire become same potential, the capacitance of the diodes is cancelled; parasite capacitance becomes smaller; and the sensitivity of the capacitance detection circuit becomes large.

Here, the first power supply is preferably positive potential and normally the positive power supply in the circuit is used. Additionally, the second power supply is preferably negative potential and normally the negative power supply in the circuit or the ground is used. The first buffer amplifier unit can be anything with the function of a buffer amplifier. The voltage gain of the first buffer amplifier is most preferably 1 but a value other than that is possible. Furthermore, the bias voltage applied to the capacitor to be detected may be AC or DC or AC over DC.

Moreover, it is acceptable that the output terminal of the first buffer amplifier unit is connected to the first junction point via a first capacitance and to the second junction point via a second capacitance, the first junction point is connected to a point having potential between potential of the first power supply and potential of the signal wire via a first resistor, and the second junction point is connected to a point having potential between potential of the second power supply and potential of the signal wire via a second resistor. At this time, it is preferable that the first resistor and the first capacitor are, respectively, a resistance value and a capacitance value that pass frequency elements of output signals from the first buffer amplifier unit corresponding to variant capacitance of the capacitor to be detected and AC component of biased voltage added to said capacitor to be detected, and the second resistor and the second capacitor are, respectively, a resistance value and a capacitance value that pass frequency elements of output signals from the first buffer amplifier unit corresponding to variant capacitance of the capacitor to be detected and AC component of biased voltage added to said capacitor to be detected. Hereby, since the output terminal of the first buffer amplifier unit is connected in AC with the first and the second junction points and the both ends of the first diode and the third diode connected to the signal wire are same potential in AC, the capacitance of the diodes is cancelled; parasite capacitance becomes smaller; and the sensitivity of the capacitance detection circuit becomes large.

Additionally, it is acceptable that a second buffer amplifier unit is connected between (i) a junction point of the first resistor and the first capacitor and (ii) the first junction point and a third buffer amplifier unit is connected between (i) a junction point of the second resistor and the second capacitor and (ii) the second junction point. Here, it is preferable that each voltage gain of the first to third buffer amplifier units is set so that potential of the first junction point and potential of the second junction point are same as potential of the signal wire. It is further preferable that the voltage gain of all the first to third buffer amplifier units is 1. Hereby, the both ends of the first diode and the third diode are kept at the same potential more securely.

Moreover, it is preferable that the first buffer amplifier unit includes a MOSFET as an input circuit, a gate of the MOSFET is connected to an input terminal of the first buffer amplifier unit, and a substrate of the MOSFET is connected to an output terminal of the first buffer amplifier unit. Hereby, the input capacitance of the first buffer amplifier unit is cancelled and the sensitivity of the capacitance detection circuit improves.

Additionally, it is acceptable that the capacitance detection circuit further includes: a testing terminal for an input of a testing signal; a testing capacitor and a switch connected in series between the input terminal of the first buffer amplifier unit and the testing terminal. Hereby, when the capacitance detection circuit is realized as a circuit divided from the capacitor to be detected, it is possible to conduct an operation test with the capacitance detection circuit itself as if the capacitor to be detected is connected even though the capacitor to be detected is not connected.

By the way, the present invention can be realized not only as the capacitance detection circuit like this but also as a capacitance detection method that improves the sensitivity by canceling the capacitance of diodes in the input protection circuit.

The capacitance detection circuit according to the present invention cancels the capacitance of the diodes connected to the signal wire among the diodes that make up the input protection circuits, and therefore the parasitic capacitance of the signal wire diminishes and the sensitivity of the capacitance detection circuit significantly improves.

Moreover, by applying, to the diodes of the input protection circuits, frequency elements of output signals from the buffer amplifier units that make up the capacitance detection circuit corresponding capacitance variance of the capacitive sensor and AC component of bias voltage added to said capacitor to be detected, voltage of the both ends of the diodes connected to the signal wire among the diodes that make up the input protection circuit become same in AC and the capacitance is cancelled. And therefore, the parasitic capacitance of the signal wire becomes smaller and the sensibility of the capacitive sensor as a capacitance detection circuit that detects capacitance variance improves significantly.

Additionally, connecting a substrate of a MOSFET and an output terminal of the buffer amplifier in the input stage of the buffer amplifier cancels the input capacitance of the buffer amplifier. And therefore, the parasite capacitance of the signal wire diminishes and the sensibility of the capacitance detection circuit improves.

Further, by incorporating a testing capacitor and a switch in the capacitance detection circuit, it is possible to make a state that the capacitive sensor is connected to the capacitance detection circuit even if the capacitive sensor is not connected. And therefore, it is possible to conduct an action test of the circuit. On the other hand, when an action test is not conducted, it is possible to connect the testing capacitor between the input terminal and the output terminal of the buffer amplifier unit.

BRIEF DESCRIPTION OF DRAWINGS

FIG. 7 is a circuit diagram in which signal voltage is written on the equivalent circuit shown in FIG. 6. FIG. 7A is a circuit diagram when the circuit is in a steady state while

BEST MODE FOR CARRYING OUT THE INVENTION

The embodiments of the present invention are explained below in detail using drawings.

THE FIRST EMBODIMENT

Figure 3:
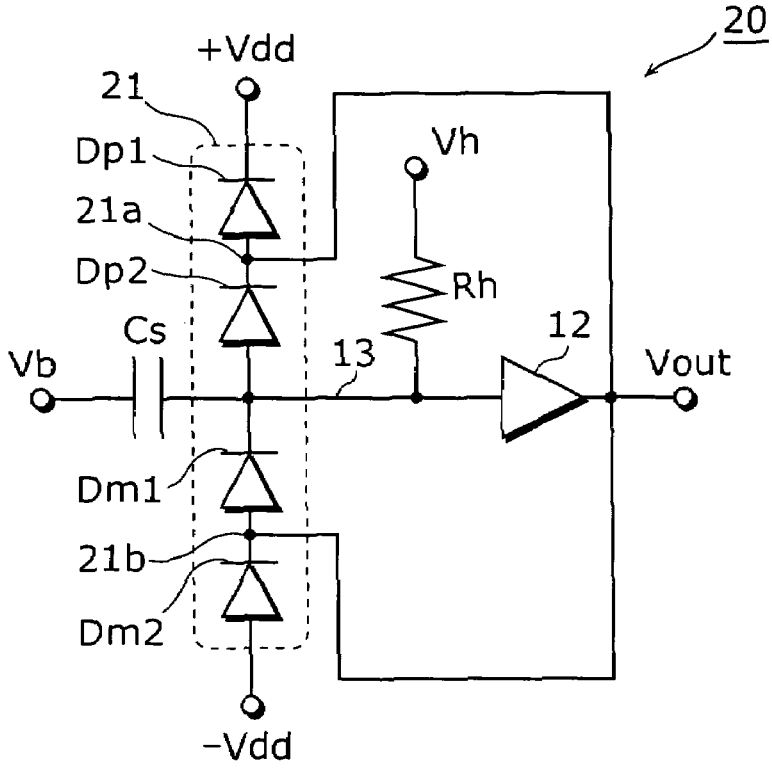
FIG. 3 is a circuit diagram of the capacitance detection circuit according to the First Embodiment of the present invention.

FIG. 3 illustrates a circuit diagram of a capacitance detection circuit 20 according to the First Embodiment as an example of the present invention.

Figure 1:
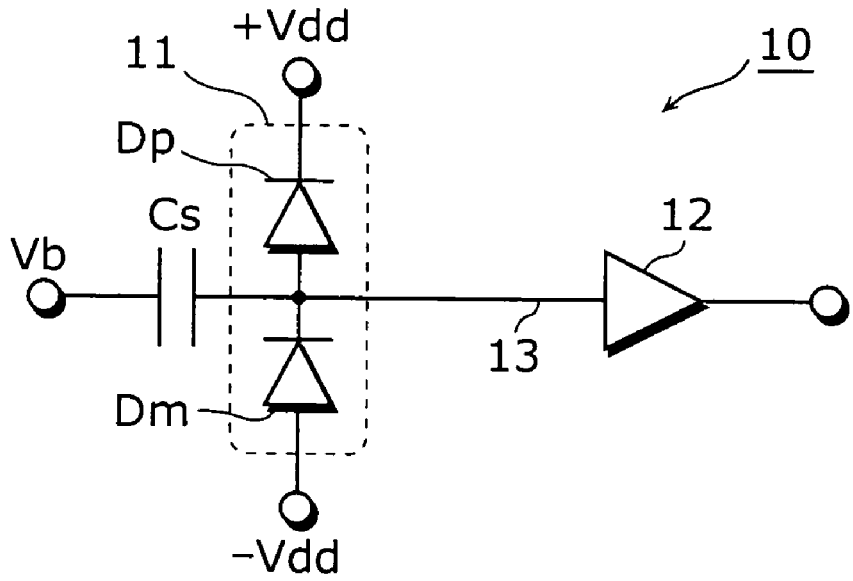
FIG. 1 is a circuit diagram of a conventional capacitance detection circuit.
Figure 2:
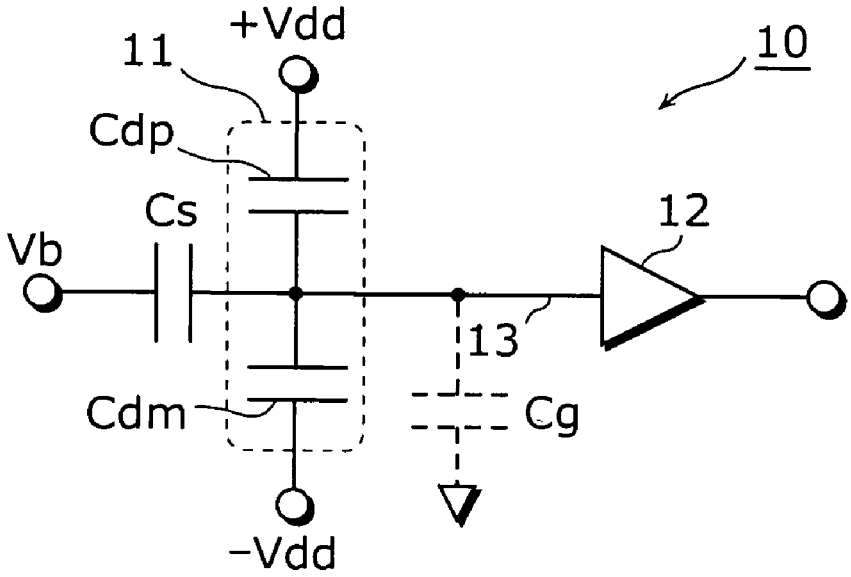
FIG. 2 is a circuit diagram of an equivalent circuit of the capacitance detection circuit shown in FIG. 1.

This capacitance detection circuit 20 is a circuit that outputs a voltage signal corresponding to capacitance of a capacitive sensor Cs and is constructed of the capacitive sensor Cs, an input protection circuit 21, a resistor Rh, a buffer amplifier 12, a signal wire 13 that connects the capacitive sensor Cs and the buffer amplifier 12 and the like. The signal wire 13 is connected to a power supply Vh via a pull-up resistor Rh and through which DC is fixed. The buffer amplifier 12 is an impedance converter of which input impedance is high, output impedance is low and voltage gain is 1. Compared with the conventional capacitance detection circuit 10 shown in FIG. 1, it is different in the construction of the input protection circuit 21, the point that the buffer amplifier 12 and the input protection circuit 21 are connected and the like. The same components as the conventional capacitance detection circuit are given the same reference numbers in the drawings, their explanation is omitted and the only different points are explained below.

The input protection circuit 21 is constructed of: two diodes Dp1 and Dp2 that are connected so that electric current between the signal wire 13 and the positive power supply (+Vdd) flows in the direction from the signal wire 13 to the positive power supply (+Vdd); and two diodes Dm1 and Dm2 that are connected so that electric current between the signal wire 13 and the negative power supply (−Vdd) flows in the direction from the negative power supply (−Vdd) to the signal wire 13.

Then, the output terminal of the buffer amplifier 12 is connected not only with the junction point 21*a* between the diode Dp1 and the diode DP2 of the input protection circuit 21 but also with the junction point 21*b* between the diodes Dm1 and Dm2.

The capacitance detection circuit 20 constructed as described above acts as follows.

Figure 4:
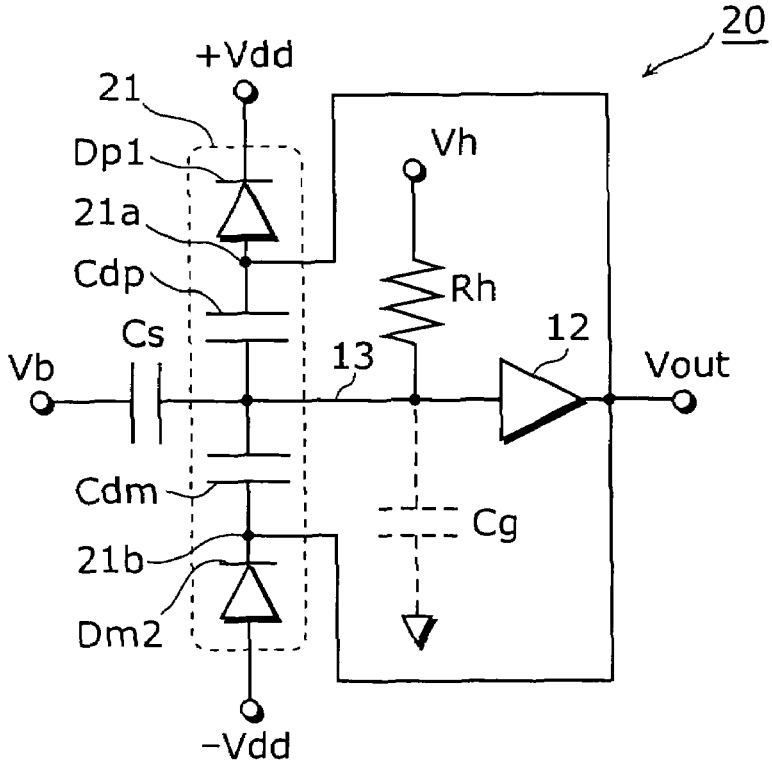
FIG. 4 is a circuit diagram of an equivalent circuit of the capacitance detection circuit shown in FIG. 3.

FIG. 4 is a circuit diagram of an equivalent circuit of the capacitance detection circuit 20 shown in FIG. 3. Here, the capacitance of the diodes Dp2 and Dm1 is illustrated as the capacitors Cdp and Cdm, respectively and the input capacitance of the buffer amplifier 12 is illustrated as the capacitor Cg.

Focusing attention on the capacitor Cdp, its both ends have the same electric potential because they are connected to the input terminal and the output terminal of the buffer amplifier 12. Similarly, the both ends of the capacitor Cdm have the same electric potential. In other words, both of these capacitors Cdp and Cdm have the same electric potential in their both ends; accumulated charge is zero; and the capacitance Cdp and Cdm are zero in appearance. This is easily understandable because in the relationship among capacitance C of a capacitor, accumulated charge Q and voltage V between the both terminals:

$$Q=C\cdot V$$

when V=0, Q=0, in other words, accumulated charge is 0 and equals, in appearance, to the case when the capacitance C is zero.

As is described above, it is possible to ignore the capacitance of two diodes Dp2 and Dm1 connected to the signal wire 13 (the capacitors Cdp and Cdm). Therefore, the parasitic capacitance Ci of the signal wire 13 is only the capacitor Cg, that is:

$$Ci=Cg$$

Consequently, compared with the parasitic capacitance Ci (=Cdp+Cdm+Cg), the capacitive component caused by the input protection circuit is reduced and therefore the sensibility of the capacitance detection circuit 20 improves by the reduced component. In other words, Ci included in the denominator of the above Equation 1 diminishes substantially and the circuit gain $$\Delta C/(Cd+\Delta C+Ci)$$

is substantially larger than the conventional one.

THE SECOND EMBODIMENT

Figure 5:
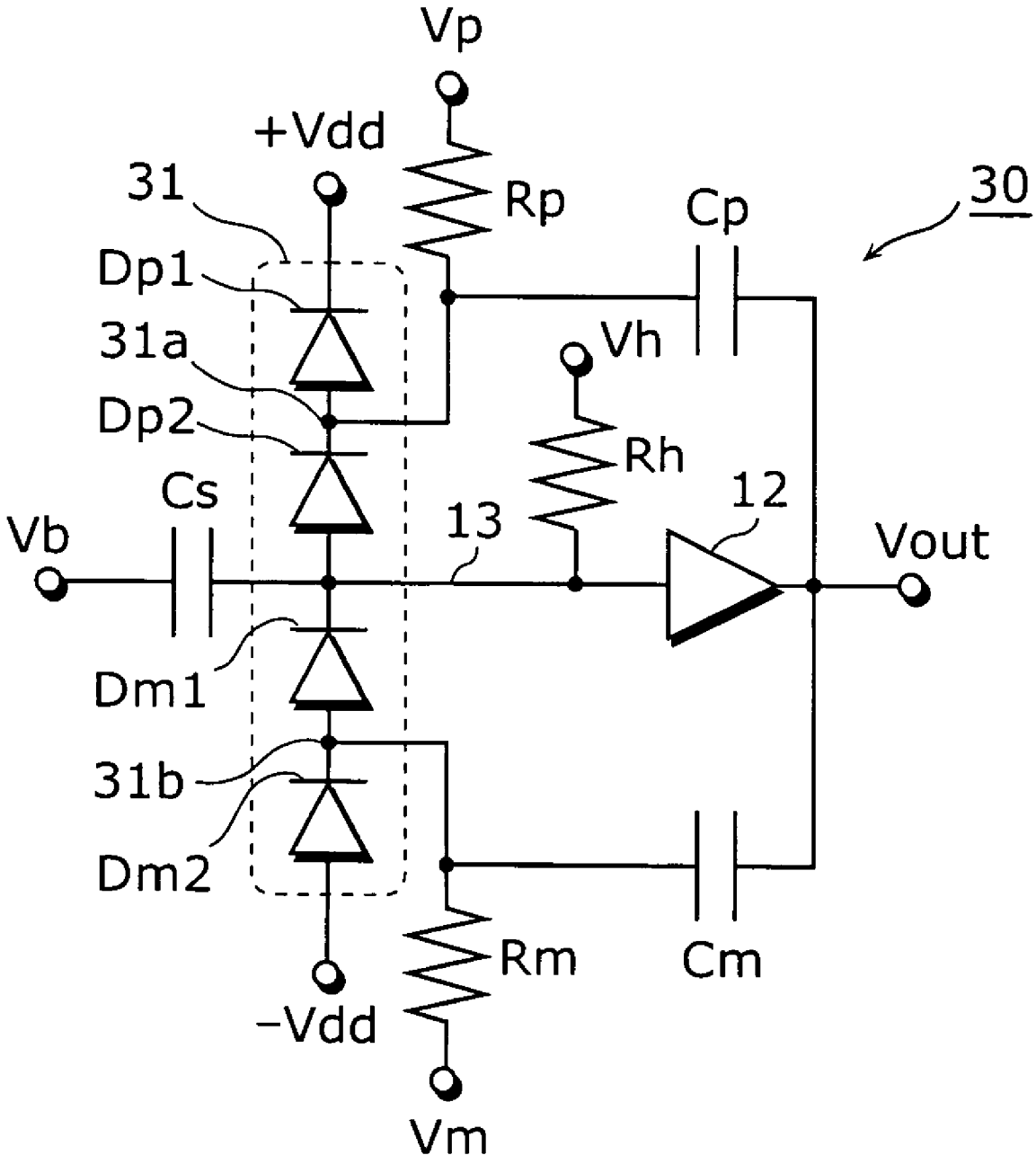
FIG. 5 is a circuit diagram of the capacitance detection circuit according to the Second Embodiment of the present invention.

FIG. 5 illustrates a circuit diagram of a capacitance detection circuit 30 according to the Second Embodiment that is an example of the present invention.

This capacitance detection circuit 30 is a circuit that outputs a voltage signal corresponding to capacitance of a capacitive sensor Cs and is constructed of the capacitive sensor Cs, an input protection circuit 31, a resistor Rh, a buffer amplifier 12, a capacitor Cp, a capacitor Cm, a signal wire 13 that connects the capacitive sensor Cs and the buffer amplifier 12 and the like. Compared with the capacitance detection circuit 20 shown in FIG. 3, it is different in the point that two capacitors Cp and Cm and two resistors Rp and Rm are added. The same components as the capacitance detection circuit 20 of the First Embodiment are given the same reference numbers in the drawings, their explanation is omitted and the only different points are explained below.

The resistor Rp is connected between fixed voltage Vp and a junction point 31*a* of a diode Dp1 and a diode Dp2 in the input protection circuit 31, and the capacitor Cp is connected between the output terminal of the buffer amplifier 12 and the junction point 31*a*. Similarly, the resistor Rm is connected between fixed voltage Vm and a junction point 31*b* of a diode Dm1 and a diode Dm2, and the capacitor Cm is connected between the output terminal of the buffer amplifier 12 and the junction point 31*b*.

The capacitor Cp and the resistor Rp construct a high pass filter with the output voltage of the buffer amplifier 12 as an input and the junction point of them as an output. And the capacitance value and the resistor value are set to be constants when a signal passes in the frequency band corresponding to variant capacitance ΔC of the capacitive sensor Cs and voltage Vb (an alternate current component) of bias supply. Similarly, as for the capacitor Cm and the resistor Rm, the capacitance value and the resistor value are set to be constants when a signal passes in the similar frequency band. Consequently, the alternate current component of the output voltage of the buffer amplifier 12 is applied to the junction point 31*b* of the input protection circuit 31 across the capacitor Cm.

Fixed voltage Vp is: value between voltage Vh of the signal wire 13 and positive power supply (+Vdd); and DC potential to bias the diodes Dp1 and Dp2 so that both of them are reverse-biased in normal operation. Similarly, fixed voltage Vm is: value between voltage Vh of the signal wire 13 and negative power supply (−Vdd); and DC potential to bias the diodes Dm1 and Dm2 so that both of them are reverse-biased in normal operation.

The capacitance detection circuit 30 constructed as described above acts as follows.

Figure 6:
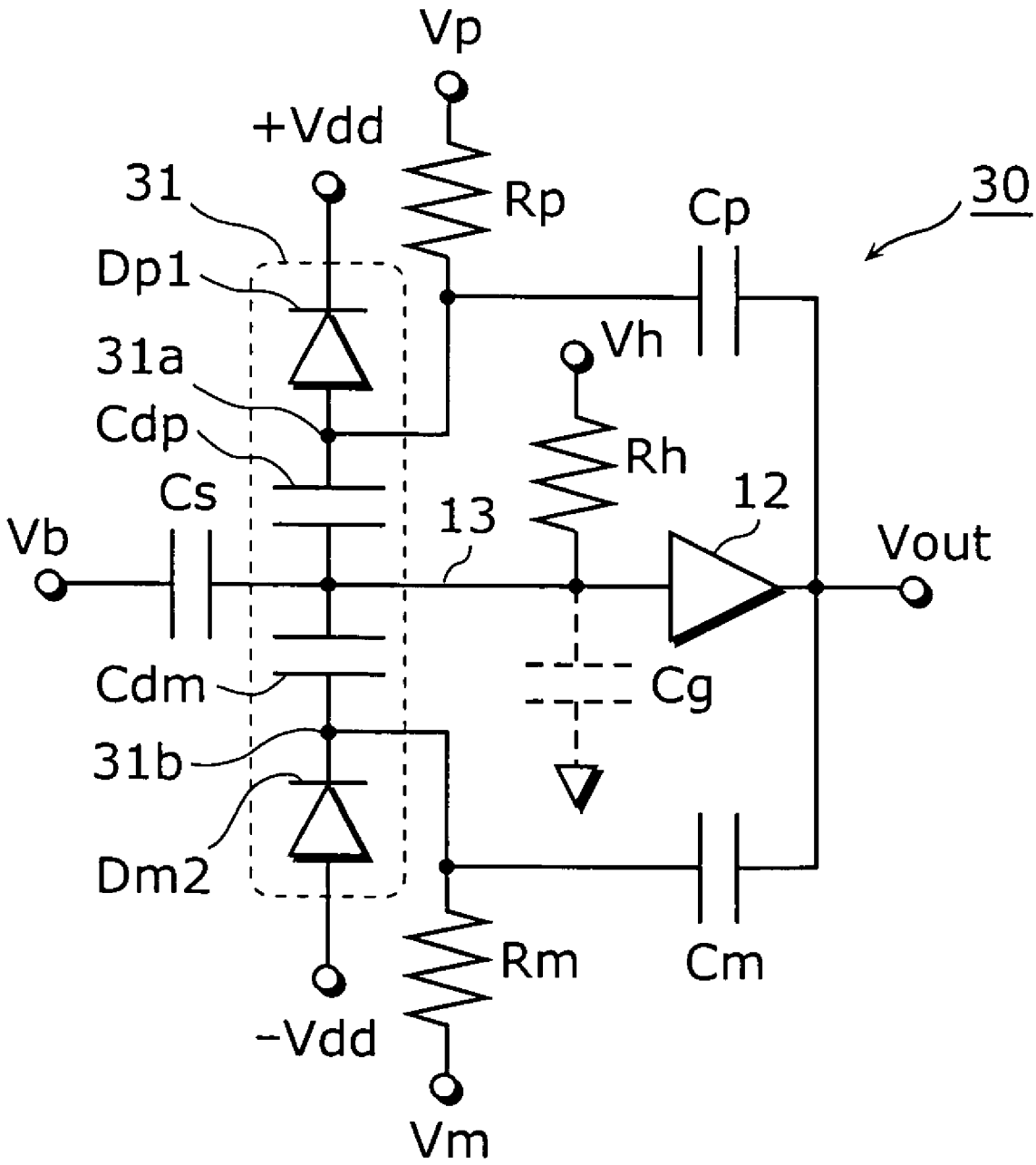
FIG. 6 is a circuit diagram of an equivalent circuit of the capacitance detection circuit shown in FIG. 5.

FIG. 6 is a circuit diagram of an equivalent circuit of the capacitance detection circuit 30 shown in FIG. 5. Here, the capacitance of the diodes Dp2 and Dm1 is illustrated as the capacitors Cdp and Cdm, respectively and the input capacitance of the buffer amplifier 12 is illustrated as the capacitor Cg.

AC voltage component in the signal wire 13 is outputted from the buffer amplifier 12, passes through the capacitors Cp and Cm and is applied to the junction points 31*a* and 31*b* of the input protection circuit 31. In other words, focusing attention on the AC component, each of the capacitors Cdp and Cdm has the same potential in the both terminals and therefore the capacitance Cdp and Cdm is zero in appearance, similarly to the First Embodiment.

As is described above, since it is possible to ignore the capacitance of two diodes Dp2 and Dm1 (the capacitors Cdp and Cdm) connected to the signal wire 13, the parasitic capacitance Ci of the signal wire 13 is only the capacitor Cg and the same effect as the First Embodiment is achieved.

The explanation of the above operation using an analytical expression is as follows.

Figure 7B:
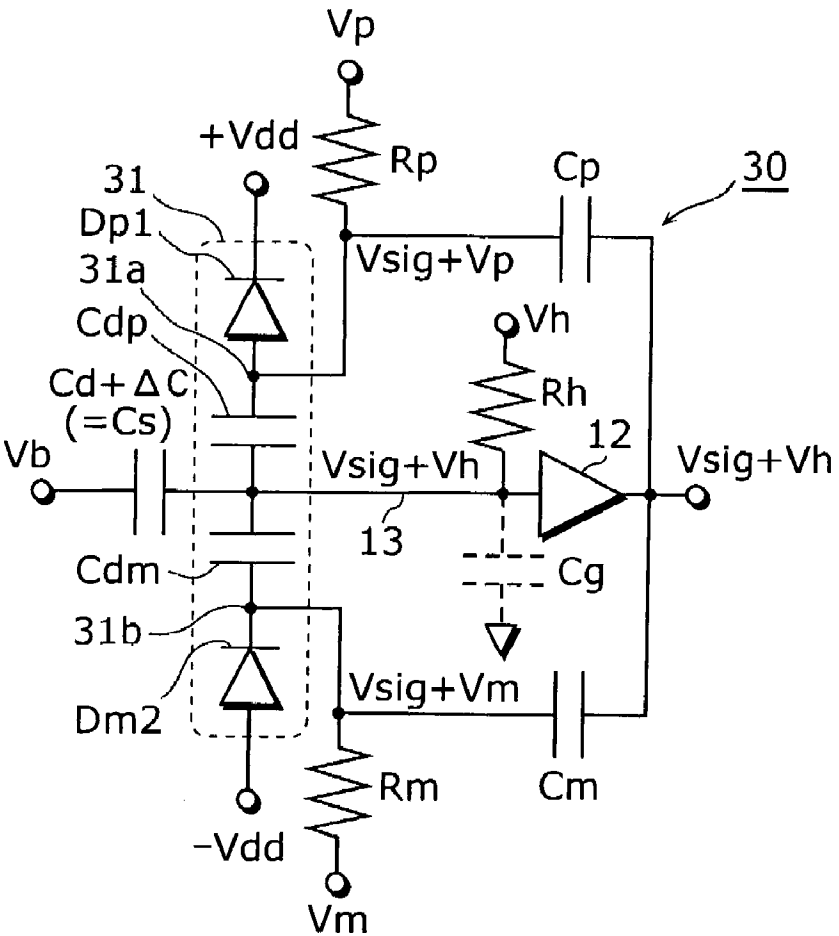
FIG. 7B is a circuit diagram when the circuit is in a variant state.
Figure 7A:
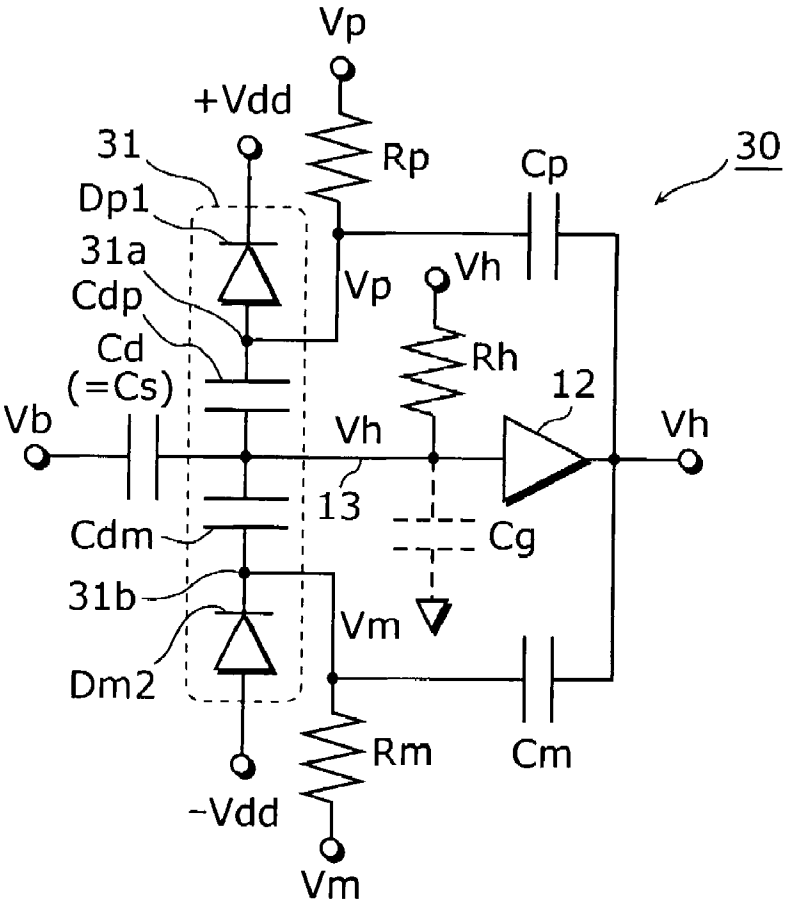

FIG. 7A is a circuit diagram on which voltage value of each point is written when the capacitance detection circuit 30 is in steady state, in other words, when the capacitive sensor Cs equals to a constant value Cd (variant capacitance ΔC=0). Here, voltage Vb is DC. In other words, the voltage of the signal wire 13 is Vh; the output voltage of the signal wire is Vh; the voltage at the junction point 31*a* of the input protection circuit 31 is Vp; and the voltage at the junction point 31*b* of the input protection circuit 31 is Vm.

On the other hand, FIG. 7B is a circuit diagram on which voltage value of each point is written when the capacitance of the capacitive sensor Cs of the capacitance detection circuit 30 is variant. In other words, the voltage of the signal wire 13 is (Vsig+Vh); the output voltage of the buffer amplifier 12 is (Vsig+Vh); the voltage at the junction point 31*a* of the input protection circuit 31 is (Vsig+Vp); and the voltage at the junction point 31*b* of the input protection circuit 31 is (Vsig+Vm).

Here, if the resistor Rh and the input resistor of the amplifier 12 are extremely high and the charge amount of the signal wire 13 is stored, the charge amount Q1 of the signal wire 13 in the steady state shown in FIG. 7A equals to the charge amount Q2 of the signal wire 13 in the variant state shown in FIG. 7B.

Here, the charge amount Q1 of the signal wire 13 in the steady state shown in FIG. 7A is:

$$Q1=Cd\cdot(Vh-Vb)+Cdp\cdot(Vh-Vp)+Cdm(Vh-VM)+Cg\cdot Vh$$

On the other hand, the charge amount Q2 of the signal wire 13 in the variant state shown in FIG. 7B is:

$$Q2=(Cd+\Delta C)\cdot(Vsig+Vh-Vb)+Cdp\cdot(Vsig+Vh-Vsig-VP)+Cdm(Vsig+Vh-Vsig-Vm)+Cg\cdot(Vsig+Vh)$$

And then, Q1=Q2 is satisfied. With these equations, the signal component Vsig corresponding to a variance in the capacitance of the capacitive sensor Cs is represented by:

$$Vsig=(\Delta C/(Cd+\Delta C+Cg))\cdot(Vb-Vh)$$

From these equations, it is apparent that the AC component of an output signal of the buffer amplifier 12 is not effected by the capacitance of the two diodes Dp2 and Dm1 (the capacitors Cdp and Cdm) of the input protection circuit 31. In other words, the parasitic capacitance Ci of the signal wire 13 is, in appearance, only the capacitor Cg and the sensibility is larger than the conventional.

The capacitance detection circuit according to the present invention is explained using two embodiments but the present invention is not limited by these embodiments.

Figure 8:
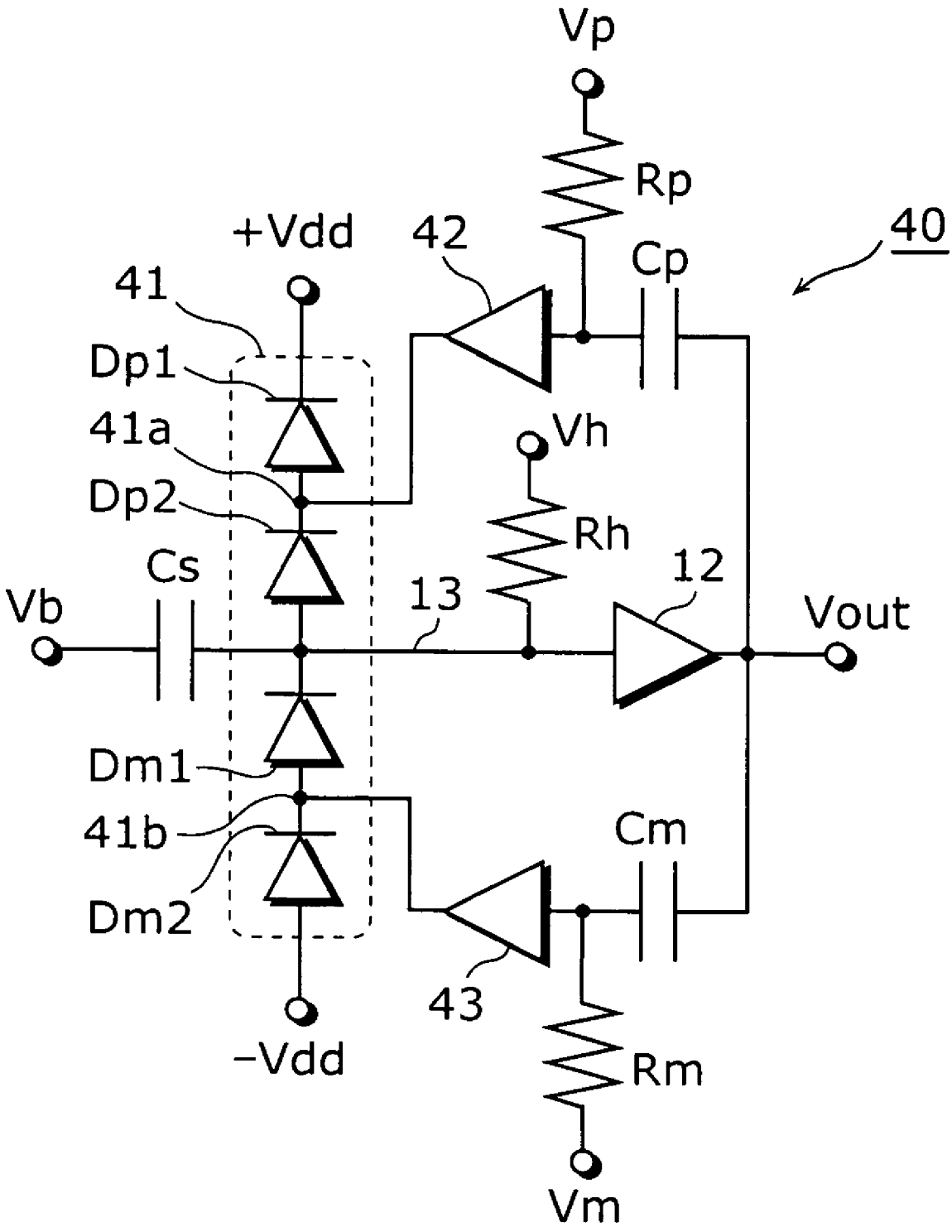
FIG. 8 is a circuit diagram of a capacitance detection circuit in which two buffer amplifiers are added to the capacitance detection circuit shown in FIG. 5.

For example, it is acceptable that voltage Vb of bias supply is AC or AC over DC. And it is also acceptable, like a capacitance detection circuit 40 shown in FIG. 8, that buffer amplifiers 42 and 43 are connected from the junction point between two diodes and the output terminal of the buffer amplifier 12 via the capacitor Cp or the capacitor Cm. This capacitance detection circuit 40 is equivalent to a circuit to which impedance converters of which input impedance is high, output impedance is low and voltage gain is 1 (buffer amplifiers 42 and 43, respectively) are inserted between the junction point 31*a* of the capacitance detection circuit 30 according to the Second Embodiment and the resistor Rp and between the junction point 31*b* and the resistor Rm. Hereby, not only the input protection circuit 41 is separated from output load of the buffer amplifier 12 but voltage is supplied to the junction points 41*a* and 41*b* of the input protection circuit 41 via the buffer amplifiers 42 and 43. Therefore, it is more securely possible to hold the potential of the both terminals of the capacitors Cdp and Cdm at the same potential.

Figure 9:
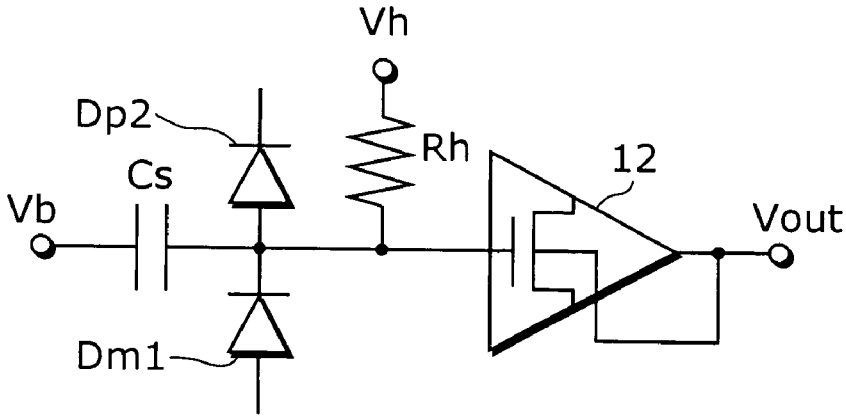
FIG. 9 is a circuit diagram in which a MOSFET substrate constructing an input stage of a buffer amplifier and the output terminal of the buffer amplifier are connected.

Additionally, as is shown in a circuit diagram in FIG. 9, when an input terminal is connected to a MOSFET gate in a circuit inside the buffer amplifier 12, the input capacitance of the buffer amplifier 12 (the capacitor Cg) is gate capacitance of the MOSFET, most of which is capacitance between a gate and a substrate. Therefore, in a case like this, it is acceptable to connect the substrate of the MOSFET and the output terminal of the buffer amplifier 12. Hereby, the capacitance between the gate and the substrate is cancelled, the parasitic capacitance Ci diminishes and the sensibility of the capacitance detection circuit improves.

Figure 10:
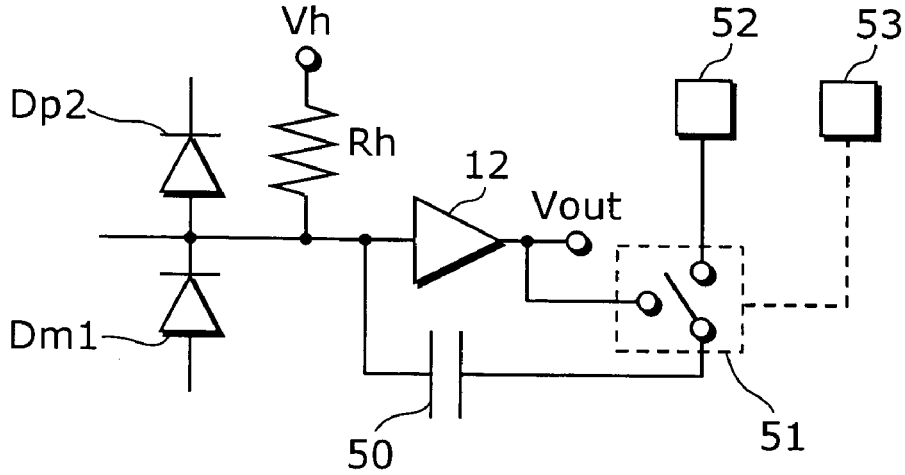
FIG. 10 is a circuit diagram in which a testing capacitor is added to a capacitance detection circuit.

Furthermore, when a capacitance detection circuit excluding the capacitive sensor Cs can be realized by a one-chip IC, a breadboard and the like, it is acceptable to add a circuit to test the capacitance detection circuit as is shown in a circuit diagram in FIG. 10. In the circuit diagram in FIG. 10, the input terminal of the buffer amplifier 12 is connected with a testing PAD (an electrode terminal of the IC) 52 via a testing capacitor 50 and a switch 51; and a control terminal of the switch 51 is connected to a switching PAD 53 (or a switching control circuit). With the construction like this, at a time of test, by applying predetermined first voltage from the switching PAD 53; connecting the switch 51 with the testing PAD 52; and making them in a testing state, the capacitive sensor (the testing capacitor 50) is in a state of being connected to the capacitance detection circuit. As a result, it is possible to test the capacitance detection circuit by inputting a testing signal to the testing PAD 52 or the like. On the other hand, after the test completes, by applying predetermined second voltage from the switching PAD 53; connecting the switch 51 with the output terminal of the buffer amplifier 12; and making the two terminals of the testing capacitor 50 have the same potential, it is possible that deterioration of the sensibility will not occur.

Figure 11A:
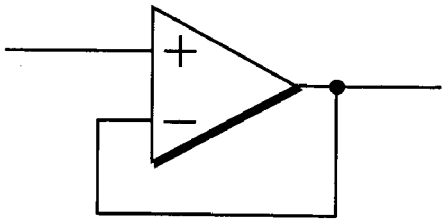
FIG. 11A and FIG. 11B are circuit diagrams showing an example of a buffer amplifier.
Figure 11B:
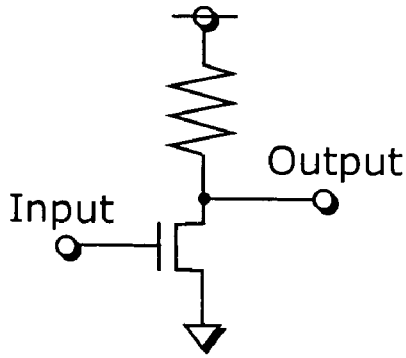

Additionally, it is acceptable to the buffer amplifiers 12, 42 and 43 are constructed of voltage follower by an operational amplifier shown in FIG. 11A or of a circuit using MOSFET shown in FIG. 11B.

Furthermore, when phase difference occurs at voltage of the both ends of the capacitors Cdp and Cdm, it is acceptable to adjust by inserting a phase compensation circuit on a loop circuit from one end to the other end of the capacitors Cdp and Cdm so that the phase difference does not occur. Or it is also acceptable to make phase compensation and adjust a passing band at the same time by when the resistors Rp and Rm are variable resistance and the capacitors Cp and Cm are variable capacitance in the capacitance detection circuit 30 according to the Second Embodiment.

INDUSTRIAL APPLICABILITY

The present invention is used as a capacitance detection circuit and particularly as a circuit that outputs a signal according to variant component of very small electrostatic capacitance, for example, a detection circuit of a capacitive sensor such as a capacitance microphone of which capacitance changes according to a variance in physical quantity.

The invention claimed is:

1. A capacitance detection circuit, comprising:

a first buffer amplifier, wherein an input of said first buffer amplifier is connected to a capacitor to be detected by a signal wire;

a first diode and a second diode, connected in series, the anode of the first diode connected to the cathode of the second diode at a first junction point, and the anode of the second diode connected to the signal wire, and the cathode of the first diode connected to a first power supply;

a third diode and a fourth diode, connected in series, the anode of the third diode connected to the cathode of the fourth diode at a second junction point, and the cathode of the third diode connected to the signal wire, and the anode of the fourth diode connected to a second power supply;

wherein:

an output terminal of the first buffer amplifier is connected to the first junction point of the first diode and the second diode via a first capacitance;

said output terminal of the first buffer amplifier is connected to the second junction point of the third diode and the fourth diode via a second capacitance;

the first junction point is connected to a point having a voltage whose value is between the voltage of the first power supply, and the voltage of the signal wire, via a first resistor;

the second junction point is connected to a point having a voltage whose value is between the voltage of the second power supply and the voltage of the signal wire, via a second resistor.

2. The capacitance detection circuit according to claim 1, wherein a voltage gain of the first buffer amplifier unit is 1.

3. The capacitance detection circuit according to claim 1, wherein the first resistor and first capacitance are components of a high pass filter that passes frequency elements of output signals from the first buffer amplifier corresponding to varying capacitance of the capacitor to be detected, and AC components of a bias voltage added to said capacitor to be detected, and the second resistor and second capacitance are, respectively, a resistance value and a capacitance value that pass frequency elements of output signals from the first buffer amplifier corresponding to varying capacitance of the capacitor to be detected, and AC components of a bias voltage added to the said capacitor to be detected.

4. The capacitance detection circuit according to claim 1, further comprising:

a second buffer amplifier unit connected between (i) a junction point of the first resistor and the first capacitor and (ii) the first junction point; and a third buffer amplifier unit connected between (i) a junction point of the second resistor and the second capacitor and (ii) the second junction point.

5. The capacitance detection circuit according to claim 4, wherein each voltage gain of the first to third buffer amplifier units is set so that voltage of the first junction point and voltage of the second junction point are same as voltage of the signal wire.

6. The capacitance detection circuit according to claim 1, wherein the first buffer amplifier unit includes a MOSFET as an input circuit, a gate of the MOSFET is connected to an input terminal of the first buffer amplifier unit, and a substrate of the MOSFET is connected to an output terminal of the first buffer amplifier unit.

7. The capacitance detection circuit according to claim 1, further comprising:

a testing terminal for an input of a testing signal; and a testing capacitor and a switch connected in series between the input terminal of the first buffer amplifier unit and the testing terminal.

8. The capacitance detection circuit according to claim 7, wherein the testing capacitor, the switch, and the first buffer amplifier are connected so that the capacitor to be detected can be connected, via the switch, between the input terminal and the output terminal of the first buffer amplifier.

9. The capacitance detection circuit according to claim 1, further comprising an AC power supply, wherein the capacitor to be detected is connected between the signal wire and an output terminal of the AC power supply.

10. The capacitance detection circuit according to claim 9, further comprising:

a first high pass filter connected between the first buffer amplifier and the first junction point; and a second high pass filter connected between the first buffer amplifier and the second junction point, wherein the first high pass filter and the second high pass filter pass frequency elements corresponding to an AC voltage outputted from the AC power supply and to varying capacitance of the capacitor for detection, wherein the frequency elements are included in a signal outputted from the first buffer amplifier.

11. A circuit that detects a capacitance of a capacitor, comprising:

a first buffer amplifier, wherein an input of said first buffer amplifier is connected to the capacitor to be detected by a signal wire, and wherein the voltage gain of the said first buffer amplifier is unity;

a first diode and a second diode connected in series between the signal wire and a first power supply, connected so that a current flows from the signal wire to the first power supply via the first and second diodes;

a third diode and a fourth diode connected in series between the signal wire and a second power supply, connected so that a current flows from the second power supply to the signal wire via the third and fourth diodes; and a resistor connected between the signal wire and a voltage that is equal to or lower in value than a voltage of the first power supply and equal to or higher than a voltage of the second power supply, wherein:

an output terminal of the buffer amplifier is connected to a first junction point of the first diode and the second diode via a first capacitance, and to a second junction point of the third diode and the fourth diode via a second capacitance;

the first junction point is connected to a point having a voltage, the value of which is between the voltage of the first power supply and the voltage of the signal wire, via a first resistor; and the second junction point is connected to a point having voltage, the value of which is between the voltage of the second power supply and the voltage of the signal wire, via a second resistor.

12. A circuit that detects a capacitance of a capacitor, comprising:

a first buffer amplifier, wherein an input of said first buffer amplifier is connected to the capacitor to be detected by a signal wire, and wherein the voltage gain of the first buffer amplifier is unity;

a first diode and a second diode connected in series between the signal wire and a first power supply, connected so that a current flows from the signal wire to the first power supply via the first and second diodes;

a third diode and a fourth diode connected in series between the signal wire and a second power supply, connected so that a current flows from the second power supply to the signal wire via the third and fourth diodes; and a resistor connected between the signal wire and a voltage, the value of which is equal to or lower in value than a voltage of the first power supply and equal to or higher than a voltage of the second power supply, a capacitor connected between an output terminal of the first buffer amplifier and a first junction point of the first diode and the second diode;

a resistor connected to the first junction point and to a point maintained at a voltage, the value of which is between the voltage of the first power supply and the voltage of the signal wire;

a capacitor connected between the output terminal of the first buffer amplifier and a second junction point of the third diode and the fourth diode; and a resistor connected to the second junction point and to a point maintained at a voltage, the value of which is between the voltage of the second power supply and the voltage of the signal wire.

13. A circuit that detects a capacitance of a capacitor, comprising:

a first buffer amplifier, wherein an input of said first buffer amplifier is connected to the capacitor to be detected by a signal wire, and wherein the voltage gain of the first buffer amplifier is unity;

a first diode and a second diode connected in series between the signal wire and a first power supply, connected so that a current flows from the signal wire to the first power supply via the first and second diodes;

a third diode and a fourth diode connected in series between the signal wire and a second power supply, connected so that a current flows from the second power supply to the signal wire via the third and fourth diodes; and a first capacitor and a second buffer amplifier connected in series between an output terminal of the first buffer amplifier and a first junction point of the first diode and the second diode;

a first resistor connected to a junction point of the first capacitor and the second buffer amplifier and connected to a point maintained at a voltage, the value of which is between a voltage of the first power supply and a voltage of the signal wire;

a second capacitor and a third buffer amplifier connected in series between the output terminal of the first buffer amplifier and a second junction point of the third diode and fourth diode;

a second resistor connected to a junction point of the second capacitor and the third buffer amplifier and to a point maintained at a voltage, the value of which is between a voltage of the second power supply and the voltage of the signal wire; and a third resistor connected between the signal wire and a voltage maintained at a value that is equal to or lower than the voltage of the first power supply, and equal to or higher than the voltage of the second power supply.

14. A method that detects capacitance of a capacitor, comprising:

connecting the capacitor to be detected and an input of a first buffer amplifier wherein the voltage gain of the first buffer amplifier is unity, via a signal wire;

connecting a first diode and a second diode in series between the signal wire and a first power supply and connecting a third diode and a fourth diode in series between the signal wire and a second power supply; and canceling capacitance of the first diode and the third diode connected to the signal wire by connecting an output terminal of the buffer amplifier to a junction point of the first diode and the second diode via a first capacitance and to a junction point of the third diode and the fourth diode via a second capacitance;

wherein the first junction point is connected to a point maintained at a voltage, the value of which is between a voltage of the first power supply and a voltage of the signal wire, via a first resistor; and the second junction point is connected to a point maintained at a voltage, the value of which is between a voltage of the second power supply and the voltage of the signal wire, via a second resistor.

* * * * *